US007040789B2

(12) United States Patent
De Lamberterie

(10) Patent No.: US 7,040,789 B2
(45) Date of Patent: May 9, 2006

(54) LAMP DEVICE FOR A MOTOR VEHICLE ILLUMINATING GANTRY POINTS

(75) Inventor: Antoine De Lamberterie, Bobigny (FR)

(73) Assignee: Valeo Vision, Bobigny Cedex (FR)

( * ) Notice: Subject to any disclaimer, the term of this patent is extended or adjusted under 35 U.S.C. 154(b) by 171 days.

(21) Appl. No.: 10/815,502

(22) Filed: Mar. 31, 2004

(65) Prior Publication Data

US 2004/0196662 A1 Oct. 7, 2004

(30) Foreign Application Priority Data

Apr. 3, 2003 (FR) ..... 03 04159

(51) Int. Cl.
*F21V 5/00* (2006.01)

(52) U.S. Cl. ..... 362/520; 362/336

(58) Field of Classification Search ..... 362/507, 362/520, 522, 538–539, 335–336
See application file for complete search history.

(56) References Cited

U.S. PATENT DOCUMENTS

| | | | | |
|---|---|---|---|---|
| 3,708,221 | A | 1/1973 | Schaefer | 359/718 |
| 5,014,173 | A | 5/1991 | Lindae et al. | 362/510 |
| 5,307,247 | A * | 4/1994 | Cejnek | 362/539 |
| 6,416,210 | B1 * | 7/2002 | Uchida | 362/539 |

* cited by examiner

*Primary Examiner*—Ali Alavi
(74) *Attorney, Agent, or Firm*—Morgan & Finnegan, LLP

(57) ABSTRACT

The invention concerns a lamp device for a motor vehicle, comprising at least one reflector, a light source producing a set of light signals possibly being reflected by the reflector, an output lens, comprising an input surface, an output surface and a focus, for producing a light beam, and a mask disposed between the reflector and the output lens for implementing a cutoff in the light beam produced.

According to the invention, the output lens comprises a set of arrangements implemented in at least one circumferential part of the output surface of the lens, this set being capable of deviating in a given direction some of the light signals encountering this arrangement.

11 Claims, 4 Drawing Sheets

Fig. 3
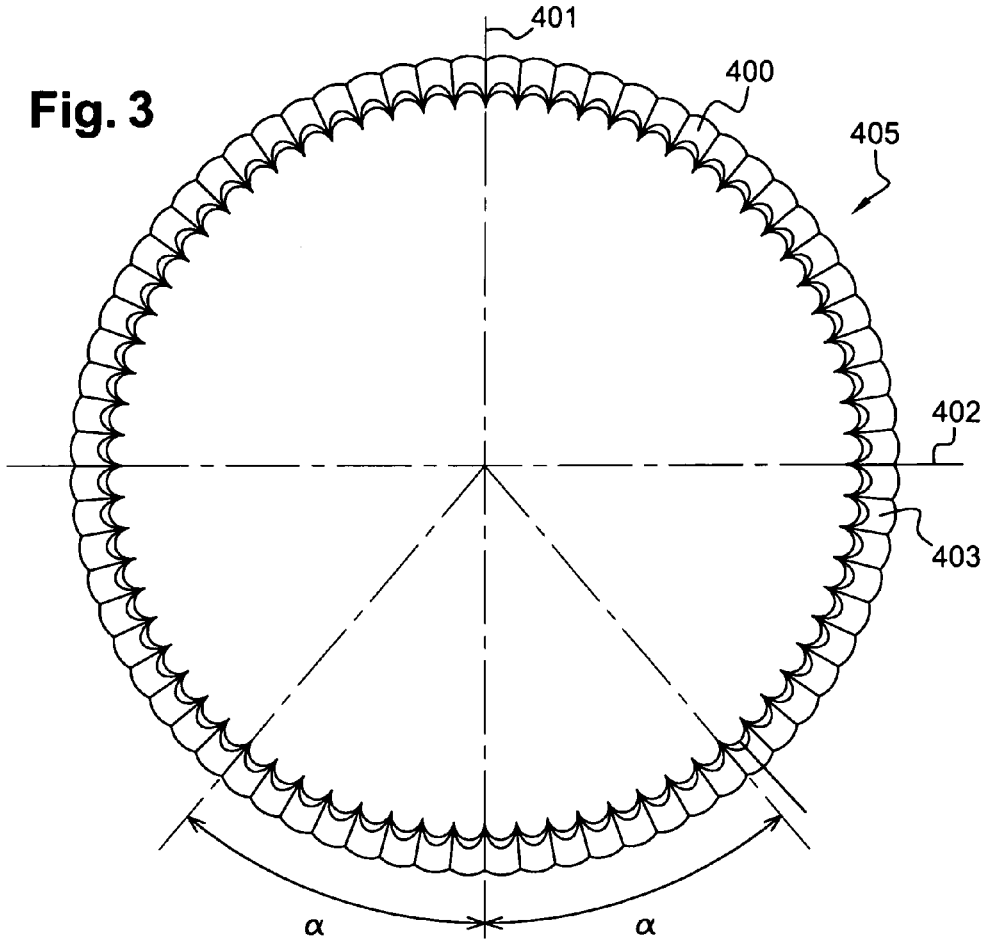
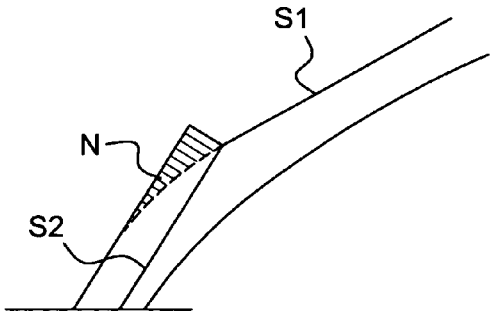
Fig. 6
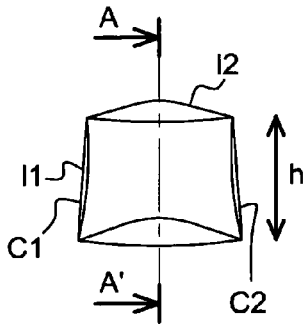
Fig. 7

LAMP DEVICE FOR A MOTOR VEHICLE ILLUMINATING GANTRY POINTS

FIELD OF THE INVENTION

The object of the present invention is a lamp device equipping motor vehicles, and making it possible to obtain illumination of gantry points in accordance with the regulations.

BACKGROUND OF THE INVENTION

Its aim in particular is to propose a particular lamp implementation which, while comprising a mask intended to prevent diffusion of light upwards, makes it possible to obtain a light intensity sufficient for satisfactory viewing of certain elements placed in different areas situated above the cutoff line of the beam emitted by the lamp.

The field of the invention is, in general terms, that of motor vehicle lamps. In this field, different types of lamp are known, amongst which there are essentially:

sidelights, of low intensity and range;

low beam, or dipped beam, headlights, of stronger intensity and with a range on the road close to 70 meters, which are used mainly at night and whose light beam distribution is such that it makes it possible to not dazzle the driver of an oncoming vehicle;

long-range high beam headlights, and additional long-range type lights, whose field of vision on the road is close to 200 meters, and which must be switched off when another vehicle is oncoming in order to not dazzle its driver;

fog lights.

The lamp device according to the invention is more particularly intended to be used as a low beam headlight, but the special nature of its structure, and in particular of its projection lens, could be reproduced on other types of lamp in order to meet different requirements.

In the prior art, essentially two types of lamp each having a distinct structure are known for low beam headlights.

The first type of lamp consists essentially of a reflector associated with a light source. The reflector consists of a mirror comprising a set of serrations, or areas of various shapes, thus producing a complex surface whose shape, which has previously formed the subject of precise calculations, makes it possible to reflect light signals emitted by the light source in order to produce a light beam essentially oriented horizontally and downwards.

The second type of lamp is illustrated in FIG. 1. This Figure depicts a sectional side view of a known low beam headlight 100 of the prior art. Such a low beam headlight comprises essentially a reflector 101, a light source 102, radiating power in the form of emitted light signals 103, disposed in the vicinity of the apex of the reflector 101, and an output surface 104 for a light beam 106. The output surface 104 can be for example a plastic type closure glass; preferably it has no optical properties, that is to say it does not deviate, or deviates very little, the light rays passing through it.

Before reaching the output surface 104, the light signals 103 are caused to pass through, either directly, or after reflection from the reflector 101, a lens 105. This lens is most often of convex type and circular. It is referred to as a projection lens. It has an input face 110 and an output face 111. It images the light beam 106, the orientation and range of which depend in particular on the disposition of the lens 105 within the lamp device 100 and the optical characteristics of the lens 105. Preferably, a central part of the light source 102 is disposed in the focal area of a first focus F1 of the reflector 101, and the focus of the projection lens 105 is situated in the focal area of a second focus F2 of the reflector 101. Thus, a light signal 103 emitted by the central part of the light source 102 will pass through the second focus F2 of the reflector 101 and will come out of the projection lens 105 horizontally or approximately horizontally. With the exception of the light signals that are reflected from ends 107 of the reflector 101, all the light signals 103 emitted by the central part of the light source 102 converge towards the second focus F2.

In general terms, the expression "light signals" designates all the light rays emitted by the light source 102, and "light beam" designates all the light rays that are actually emitted by a lamp at the output surface 104, or at the projection lens 105.

In this second type of lamp, a mask 108 is interposed between the reflector 101 and the projection lens 105. The mask 108 is disposed in a plane parallel to the projection lens 105, approximately at the object focal plane of the lens, so that the image of the mask is emitted at infinity. By virtue of the presence of such a mask 108, the light beam 106 which is actually emitted by the lamp device 100 is not emitted above a cutoff line determined by the shape of an upper part 109 of the mask 108.

FIG. 2 gives an example of the shape 200 of the light beam 106 projected on a screen. A cutoff line 201 marks the boundary between a low area where the light intensity is sufficient to illuminate the road and complies with the various regulations laid down, and a high area where the light intensity is almost zero. The cutoff line 201 has a change in height 203 in the region of a central axis 202 of the beam. The shape 201 depicted, with a light beam higher on the right-hand part of the projection, corresponds to that of a lamp for a vehicle travelling in a country where driving on the right is prescribed. In a country where driving on the left is prescribed, a shape would be obtained which, with respect to a vertical axis 202, would be symmetrical to that depicted.

The two types of lamp described are available on the market today. Motor vehicle manufacturers choose one or other of these types of lamp essentially according to aesthetic criteria, the two types of lamp not having the same appearance.

However, a problem arises with the second type of lamp described. This is because, although it is true that the light intensity must be low above the cutoff line 201, the various regulations nevertheless lay down that a minimum light intensity be emitted in certain directions situated above the cutoff line 201. In particular, various regulations lay down a minimum light intensity at certain points situated above the cutoff line, these points being referred to as gantry points, since they correspond approximately to places in the vicinity of which signs of motorway sign type are located when these signs are at a given visibility distance from the vehicle. For example, in one American regulation, there are three gantry points which are respectively situated at 2u4l, 4u8and 4u8r with respect to the optical axis of the lens and a line 1.5u1r to 3R, the figures corresponding to degrees, "u" corresponding to "up", "l" corresponding to "left", and "r" corresponding to "right".

Various solutions have been proposed in the prior art to make it possible to illuminate these gantry points while retaining the mask 108 in the lamp device.

A first solution consists of providing a hole in the mask 108. If this hole is disposed in the correct place, an approximately rectangular illuminated area is then obtained above the cutoff line, this area containing the gantry points. The statutory requirements are thus satisfied, but the diffused light intensity in the rectangle is such that it is unpleasant—perhaps even a hindrance—for the driver.

A second known solution consist of slightly roughening the input face of the lens 105. Some of the light signals are thus deviated from their initial path and some are emitted in the direction of the gantry points. But such a procedure has a number of drawbacks: on the one hand, the roughened surface diffuses light almost isotropically, a large amount of energy being wasted, including in areas of the beam where the intensity is already relatively low; on the other hand, it is necessary to carry out a post-treatment of the lens after moulding. In practice, a surfacing operation has therefore to be performed in order to obtain a slightly roughened face, this operation following the moulding operation.

The device according to the invention answers the problems that have just been described. In general terms, the device according to the invention proposes a solution that makes it possible to provide in a controlled manner a light intensity at the gantry points and in the vicinity of these points, while retaining the presence of a mask in order to not dazzle oncoming motorists and retaining good homogeneity of the light beam produced by the lamp device for illuminating the road.

To that end, in the invention, a modification is proposed of the output surface of the projection lens, and more particularly of certain areas of this output surface.

SUMMARY OF THE INVENTION

To do this, the invention proposes a lamp device for a motor vehicle, comprising at least one reflector, a light source producing a set of light signals possibly being reflected by the reflector, an output lens, comprising an input surface, an output surface and a focus, for producing a light beam, and a mask disposed between the reflector and the output lens for implementing a cutoff line in the light beam produced, characterised in that the output lens comprises a set of arrangements implemented in at least one circumferential part of the output surface of the lens, this set being capable of deviating in a given direction some of the light signals encountering this arrangement.

According to a preferred embodiment, the deviation directions are directions situated above the cutoff line.

And preferably, these arrangements are capable of deviating some of the light signals encountering this arrangement in a direction corresponding to a gantry point.

According to a first implementation variant, this circumferential part is disposed on the lower part of the lens.

In this case, preferably, it is substantially symmetrical with respect to a vertical plane of symmetry of the lens.

Advantageously, this circumferential part extends over approximately 45° on each side of said plane of symmetry.

This first variant has the advantage of modifying the external appearance of the lens only minimally and of therefore being very unobtrusive visually.

According to a second implementation variant, this circumferential part extends over the entire perimeter of the lens.

This second preferred implementation variant has the advantage of entailing no constraint of angular positioning of the lens. However, it turns out that implementation of the polarisation arrangement, of the type of a notch on the lens fitting over a rib on its support, is a relatively tricky operation in view of the fragility of such lenses.

More precisely, preferably, this circumferential part consists of a tapered surface with a rectilinear generator inclined by an angle determined in order to obtain a deviation upwards of the optical signals coming from the focus and passing through it at the low point of the lens.

Preferably, this deviation is between 2° and 10°.

Advantageously, this circumferential part is formed of convex ribs disposed on said tapered modified surface of the lens.

In this case, advantageously, said convex ribs are produced by rotation on said tapered surface of a light dispersal rib determined in order to obtain a lateral dispersal of the light at the low point of the lens.

A lens in accordance with the invention can be designed by simulation and therefore its method of manufacture is stable. It can even be standardised and used for different projection devices.

It can furthermore be mass produced by a single moulding operation. Its manufacture is therefore particularly economical.

Losses in terms of range and flux in the optical beam are very low, of the order of 2%.

Another object of the invention is a motor vehicle equipped with a lamp device including at least one of the characteristics that have just been mentioned.

The invention is described below in more detail with the support of the figures depicting only one preferred embodiment of the invention. In particular, the lamp device according to the invention is illustrated in the case of use in a low beam headlight, but this device is suitable for any lamp device of a vehicle.

BRIEF DESCRIPTION OF THE DRAWINGS

FIG. 3 is a front view of a lens in accordance with the invention.

FIG. 6 is a detail sectional view along the plane A–A' of the lens in accordance with the invention, illustrating the second and third steps in the production of this lens.

FIG. 7 is a perspective view of a rib, an arrangement in accordance with the invention.

DESCRIPTION OF THE PREFERRED EMBODIMENTS

Figure 1:
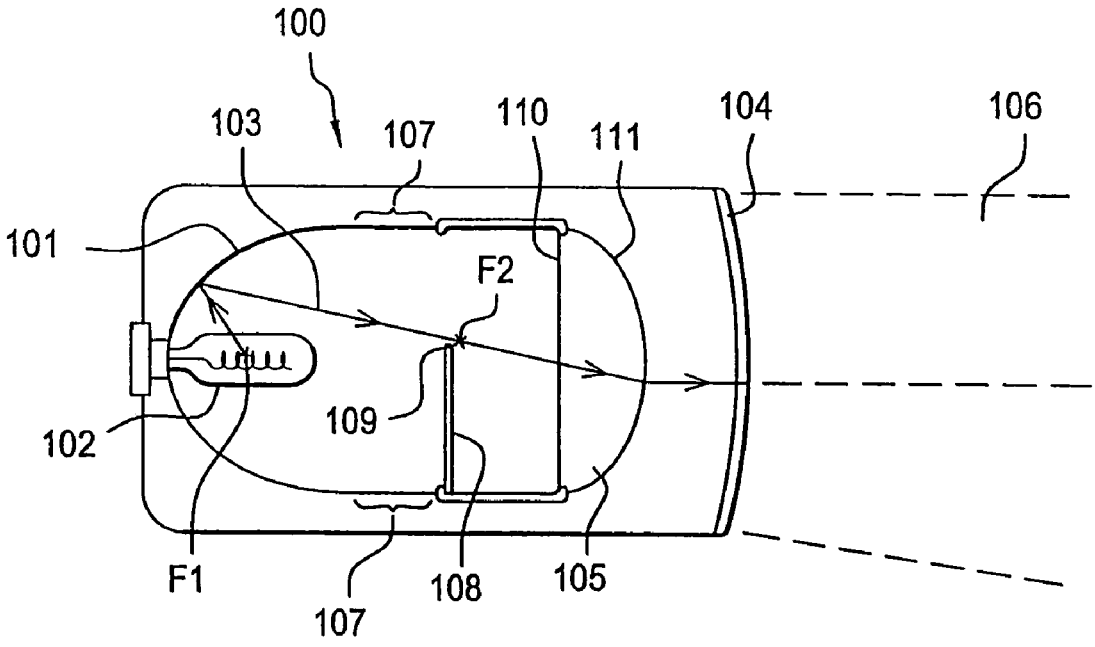
Fig. 1 PRIOR ART
FIG. 1, already described, is a sectional side view of a lamp device of the prior art.
Figure 2:
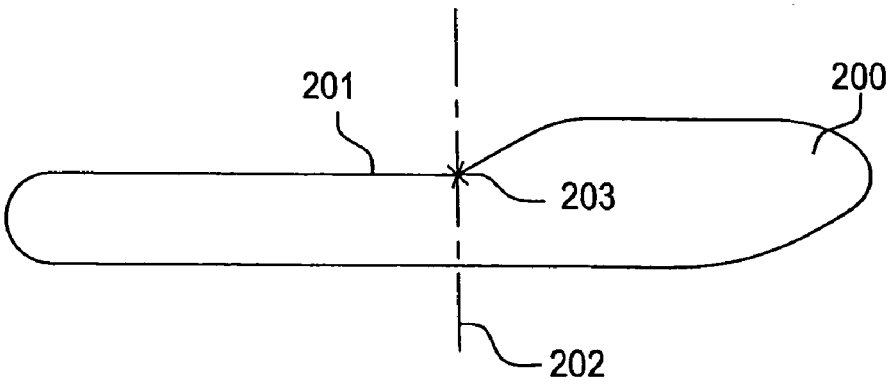
Fig. 2 PRIOR ART
FIG. 2, already described, is a depiction of the projection of the light beam emitted by the lamp device of FIG. 1.

In the different figures, the elements that are common to a number of figures have the same references.

FIG. 3 shows a projection lens 405 in a front view, that is to say such as it can be seen when facing the lamp. The lens can be circular or elliptical. A vertical axis 401 and a horizontal axis 402 intersect at the centre of the circle forming the circumference of the lens.

The output lens 405 here comprises a set of arrangements implemented over its entire perimeter of the output surface of the lens, this set being capable of deviating in a given direction some of the light signals encountering it.

The deviation directions are directions situated above the cutoff and each corresponding to a gantry point.

This preferred embodiment has the advantage of not entailing any constraint of angular positioning of the lens.

However, within the context of the invention, it is sufficient for this set of arrangements to be disposed on the lower or upper part of the lens. Preferably, but this is not absolutely essential, it is symmetrical with respect to a vertical plane of symmetry of the lens containing the vertical axis 401. This set is then situated over an angular range with angle at the centre $2\alpha$, $\alpha$ being advantageously substantially equal to 45°. This set can therefore also be substantially symmetrical only, perhaps even completely asymmetrical.

This circumferential part 400 formed of this set of arrangements consists of convex ribs 403 disposed on a tapered modified circumferential area of the lens.

This structure of this circumferential part 400 will be clarified with reference to the following figures.

The following FIGS. 4 and 5 depict schematically a first step in the production of a lens in accordance with the invention.

Figure 4B:
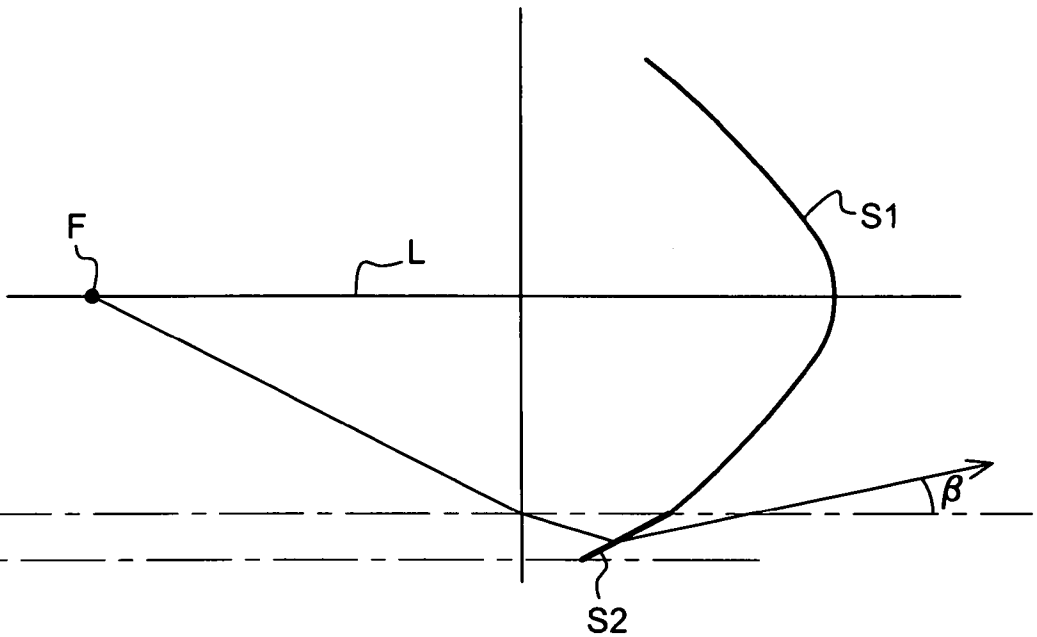
FIGS. 4A and 4B are schematic views of a front view and a sectional view of a lens and illustrate a first step in the production of a lens, according to a first embodiment.
Figure 4A:
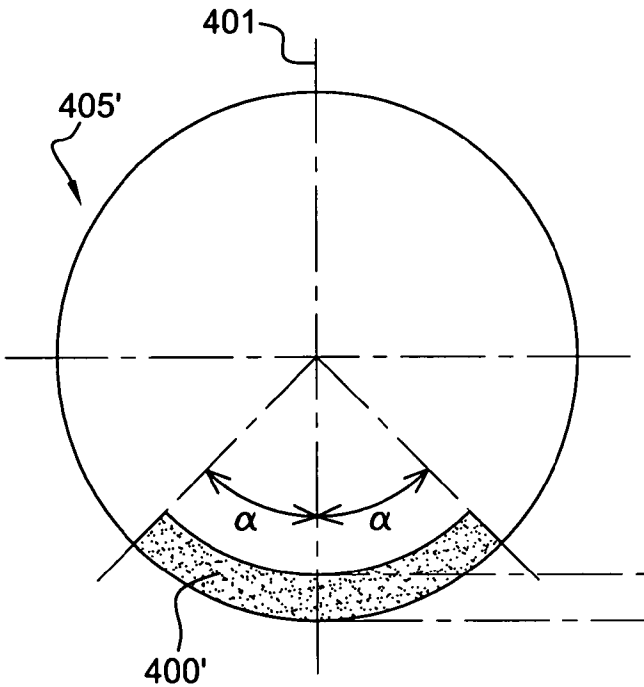

According to a first non-limiting embodiment depicted in FIGS. 4A and 4B, the circumferential part 400' is disposed on the lower part of the lens 405' and is preferably symmetrical with respect to a vertical plane of symmetry of the lens, whose path in the plane of the figure is the vertical axis 401. This circumferential part extends over an angle $\alpha$, preferably equal to approximately 45°, on each side of this plane of symmetry.

The external surface of the lens, as well as its focus F and its optical axis L, are depicted in FIG. 4B. This surface is shown schematically by the ellipse S1. The first step in the production of a modified lens in accordance with the invention consists of producing a tapered surface with a rectilinear generator centred on the optical axis L of the lens shown schematically by the line S2. This surface S2 is defined in order to obtain a deviation upwards of the optical signals coming from the focus F passing through it at the low point of the lens. Advantageously, in order to implement the gantry points required by the standards, this deviation has an angle $\beta$ between 2° and 10°, preferably between 5° and 9°.

The advantage of producing this circumferential part only in the lower part of the lens lies in a concern for aesthetic unobtrusiveness. This part will be less visible on the vehicle.

Furthermore, it also lies within the context of the invention to produce this tapered part in the upper part of the lens. However, the embodiment described here is preferred, since it proves more efficient as regards light energy.

Figure 5B:
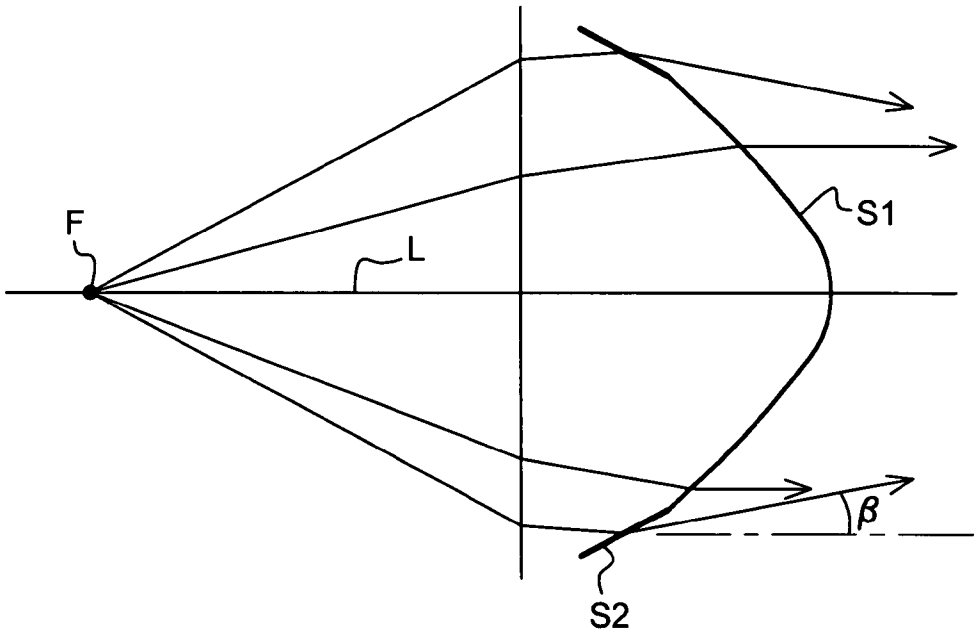
FIGS. 5A and 5B are schematic views of a front view and a sectional view of a lens and illustrate a first step in the production of a lens, according to a second embodiment.
Figure 5A:
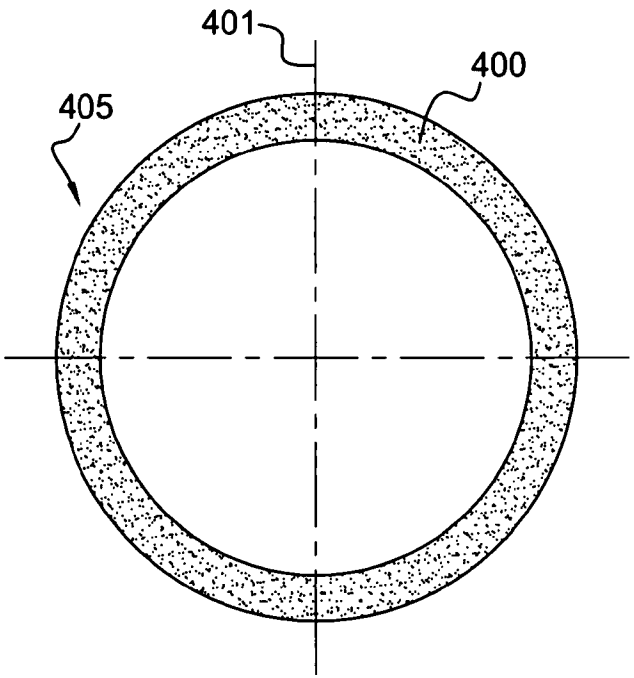

According to a second embodiment depicted in FIGS. 5A and 5B, the circumferential part 400 is disposed over the entire perimeter of the output surface of the lens. The external surfaces of the lens S1 and S2 are defined in a manner identical to those of the preceding figure.

This second embodiment has the advantage of entailing no constraint of angular positioning of the lens in the lamp.

If, in the state resulting from this first production step, some of the light rays passing through the lens are diverted at this part 400 or 400' in order to reorient the power thus diverted towards the gantry points forming the subject of regulations in terms of minimum light intensity to be received, it turns out that this diversion concentrates the deviated light in a central area in proximity to the central axis 202 above the cutoff 201. It is therefore not sufficient to fulfil the more demanding requirements of the standards and does not implement all the standardised gantry points. It is therefore necessary to disperse the light beam thus obtained laterally at this central area.

In order to solve this problem, as illustrated in FIG. 6, convex ribs are disposed over the whole of this tapered surface S2. Their pitch is defined so as to obtain an integer number of ribs over the perimeter of the lens and sufficiently small in order to not interfere on the angular position of the lens. Preferably, this pitch corresponds to an angle at the centre of 1° to 5°, as seen in FIG. 3. Their maximum thickness is calculated in order to deviate only the light necessary, that is for example for a lens of diameter equal to 70 mm, a thickness of the order of 3 mm.

Such a rib is depicted in perspective in FIG. 7 with its plane of symmetry A–A'. By way of example, its height is of the order of 3 to 5 mm, the radius of curvature of its line l2 representative of its convexity, or horizontal radius, is of the order of 20 mm and the radius of curvature of the line l1 of its lateral edge, or vertical radius, is very large, this edge being almost rectilinear.

In more general terms, the horizontal radius is determined in a manner known to persons skilled in the art in order to achieve sufficient illumination laterally to the central area already mentioned, more precisely, according to certain standards, 8° on each side of the central axis of this area. As for the vertical radius, this is determined in a manner known to persons skilled in the art in order to obtain the desired vertical distribution of the light.

The set of convex ribs on the lens is produced by rotation on the tapered surface S2 of a light dispersal rib as described previously with its lateral sides c1 and c2 corresponding to the surface S2 and determined in order to obtain the desired dispersal of the light at the low point of the lens.

Returning to FIG. 6, the ribs N, one of which is here in a sectional view along its plane of symmetry A–A', are next levelled in the continuation of the profile of the surface S1, which is shown schematically in this figure by the removal of the hatched part.

Advantageously, the sharp-angled slits existing between each rib will be filled in with production of a rounded edge, in order to improve the aesthetic result.

Once determined, such a lens can be manufactured by moulding.

It should be noted that the only condition for providing compliant photometry on the gantry points is that the light reaches the low point of the lens. This is the case in the majority of elliptical lamp modules. In the contrary case, it is sufficient to provide an increase in height of the reflector in order to reach the low point of the lens or to design the lens with a smaller diameter in order that its low point corresponds to the limiting reflection of the reflector, which leads to a lens of small size and reduced weight, which is particularly advantageous.

What is claimed is:

1. Lamp device for a motor vehicle, comprising at least one reflector, a light source producing a set of light signals possibly being reflected by the reflector, an output lens, comprising an input surface, an output surface and a focus, for producing a light beam, and a mask disposed between the reflector and the output lens for implementing a cutoff in the light beam produced, characterized in that the output lens comprises a set of arrangements implemented in at least one circumferential part of the output surface of the lens, this set being capable of deviating in a given direction some of the light signals encountering this arrangement, wherein this circumferential part consists of a tapered surface with a rectilinear generator inclined by an angle determined in order to obtain a deviation upwards of the optical signals coming from the focus and passing through it at the low point of the lens.

2. Lamp device according to claim 1, wherein the deviation directions are directions situated above the cutoff.

3. Lamp device according to claim 1, wherein these arrangements are capable of deviating some of the light signals encountering these arrangements in a direction corresponding to a gantry point.

4. Device according to claim 1, wherein this circumferential part is disposed on the lower part of the lens.

5. Device according to claim 4, wherein this circumferential part is substantially symmetrical with respect to a vertical plane of symmetry of the lens.

6. Device according to claim 5, wherein this circumferential part extends over approximately 45° on each side of the plane of symmetry.

7. Device according to claim 1, wherein this circumferential part extends over the entire perimeter of the lens.

8. Device according to claim 7, wherein this circumferential part is formed of convex ribs disposed on said tapered modified surface on the lens.

9. Device according to claim 8, wherein said convex ribs are produced by rotation on said tapered surface of a light dispersal rib determined in order to obtain a lateral dispersal of the light at the low point of the lens.

10. Device according to claim 1, wherein said deviation is between 2° and 10°.

11. Motor vehicle equipped with a lamp device according to claim 1.

* * * * *